US006283270B1

(12) United States Patent
Robibero et al.

(10) Patent No.: US 6,283,270 B1
(45) Date of Patent: Sep. 4, 2001

(54) ESCALATOR STEP WITH REMOVABLE DEMARCATION INSERTS

(75) Inventors: Vincent P. Robibero, Randolph, NJ (US); Terry Holmes, Clinton, NC (US); Melanie J. Smith, Bedminster, NJ (US)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/464,251

(22) Filed: Dec. 16, 1999

(51) Int. Cl.[7] ..... B66G 23/12
(52) U.S. Cl. ..... 198/333
(58) Field of Search ..... 198/333, 324, 198/328

(56) References Cited

U.S. PATENT DOCUMENTS

| | | | | |
|---|---|---|---|---|
| 3,986,595 | * | 10/1976 | Asano et al. | 198/333 |
| 4,362,232 | * | 12/1982 | Saito et al. | 198/333 |
| 4,374,558 | * | 2/1983 | Saito | 198/333 |
| 4,397,383 | * | 8/1983 | James | 198/333 |
| 4,413,719 | * | 11/1983 | White | 198/333 |
| 4,519,490 | * | 5/1985 | White | 198/333 |
| 4,570,781 | * | 2/1986 | Kappenhagen | 198/333 |
| 4,756,398 | * | 7/1988 | Watanabe et al. | 198/324 |
| 4,775,043 | * | 10/1988 | Tomidokoro | 198/328 |
| 4,805,757 | * | 2/1989 | Wilcox | 198/333 |
| 4,858,745 | * | 8/1989 | Haas et al. | 198/333 |
| 4,984,672 | * | 1/1991 | Saito et al. | 198/333 |
| 5,082,102 | | 1/1992 | Reichmuth | 198/333 |
| 5,242,042 | * | 9/1993 | Mauldin | 198/333 |
| 5,337,879 | * | 8/1994 | Fischer | 198/333 |
| 5,560,468 | * | 10/1996 | Inoue | 198/333 |

FOREIGN PATENT DOCUMENTS

| | | | |
|---|---|---|---|
| 2161442 | 7/1972 | (DE) | B66B/9/12 |

* cited by examiner

*Primary Examiner*—H. Grant Skaggs
*Assistant Examiner*—Rashmi Sharma
(74) *Attorney, Agent, or Firm*—Schweitzer Cornman Gross & Bondell LLP

(57) ABSTRACT

An escalator step pallet has step tread and front riser portions joined together with side edges. The side edges are provided with a peripheral slot to accept replaceable demarcation inserts which identifies the side edges. The slot on the step pallet is provided with guides extending along its length to accept channels of the demarcation inserts and orient the demarcation inserts on the step pallet. Preferably, a pair of demarcation inserts are provided for each step edge, the first insert extending along the step tread and the second insert extending along the riser. The two inserts may interlock. In addition, each of the inserts is provided with a locking device which mates with a corresponding element on the step pallet to retain the insert in position. The locking device may be for example, a hook arm which engages a projection on the bottom surface of the step pallet. An access slot is provided through the insert and pallet to permit a tool to contact the hook arm to release the lock when removal of the insert is desired.

11 Claims, 9 Drawing Sheets

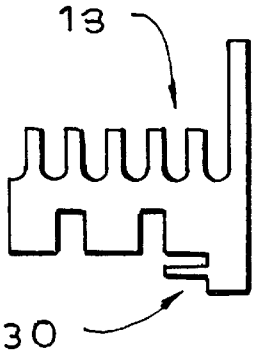
FIG. 8
FIG. 7
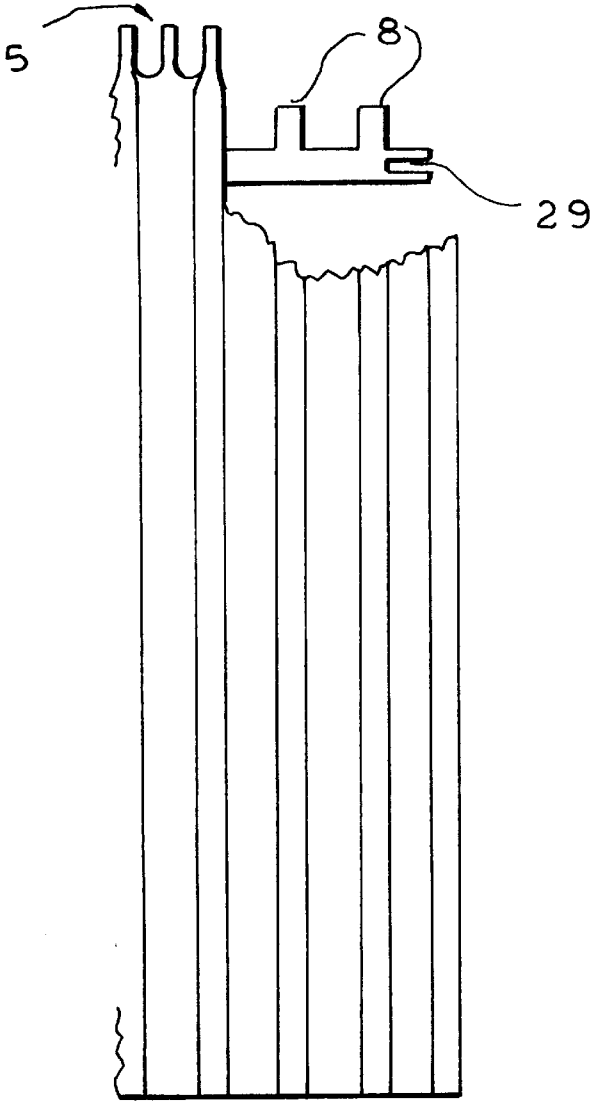

ESCALATOR STEP WITH REMOVABLE DEMARCATION INSERTS

BACKGROUND OF THE INVENTION

Escalator steps are usually formed by a casting or extrusion manufacturing process. The step plates are preformed with a tread pattern on the step pallet top and riser. Typically, the treads are in the form of a series of parallel grooves extending from the front to the back of the plate. The grooves are further dimensioned to engage with comb structures at the floor landing portions of the escalator.

As the escalator steps are in constant motion with respect to the escalator sides or balustrades, demarcation means are typically applied to the steps to facilitate safe use of the escalators. The demarcation means provide a visual aid which helps the rider locate and thus avoid the sides and forward riser edges of the step. Typically, the demarcation means comprise a colored marking which is in contrast to the other portions of the step. The demarcation means may also provide a physical barrier to the side edges of the step by being slightly raised above the tread level of the step surface.

Current methodologies for applying demarcation means to an escalator step edge include the painting of an appropriate strip onto the step surface, mounting a demarcation strip upon the surface of a step edge by the use of screws, nuts or bolts or rivets, or preforming a demarcation riser as part of the casting or extrusion step in the manufacture of the step.

The use of painted strips requires constant maintenance, as the markings wear away upon use. The fastening of a demarcation strip with screws, rivets and the like, upon the step surface provide concentrated mechanical stresses about the fastening points and often lead to premature failure. The incorporation of demarcation strips as part of the step proper prevents replacement and substantially increases the costs of manufacture.

It is accordingly a purpose of the present invention to provide a new and improved demarcation strip for use on escalator steps which may be easily replaced as required.

A further purpose of the present invention is to provide a demarcation strip which is easily mountable and replaceable on the step, and which does not generate localized forces which may lead to premature failure.

A still further purpose of the present invention is to provide an escalator step formed to accept replaceable demarcation strips having the aforementioned characteristics.

BRIEF DESCRIPTION OF THE INVENTION

In accordance with the foregoing and other purposes and objects, the demarcation strip of the present invention comprises an insert which is mountable to an escalator step through the mating of corresponding portions of the step and insert forming a friction and/or interference lock arrangement. The escalator step is formed with recessed edge portions adapted to accept the insert whereby the insert serves as the respective edge of the step. The demarcation strip can be formed in separate riser and tread portions which interconnect upon mounting to the step to provide increased rigidity and stability.

BRIEF DESCRIPTION OF THE DRAWINGS

A fuller understanding of the present invention will be obtained upon consideration of the following description of preferred, but nonetheless illustrative embodiments of the invention when reviewed in association with the annexed drawings, wherein:

FIG. 7 is a front elevation view, partially broken away, of a portion of an escalator step pallet incorporating cast-in retaining channels to bold demarcation inserts of the present invention in place;

FIG. 8 is section view of a demarcation insert formed to mount on the step pallet depicted in FIG. 7;

DETAILED DESCRIPTION OF THE INVENTION

Figure 1:
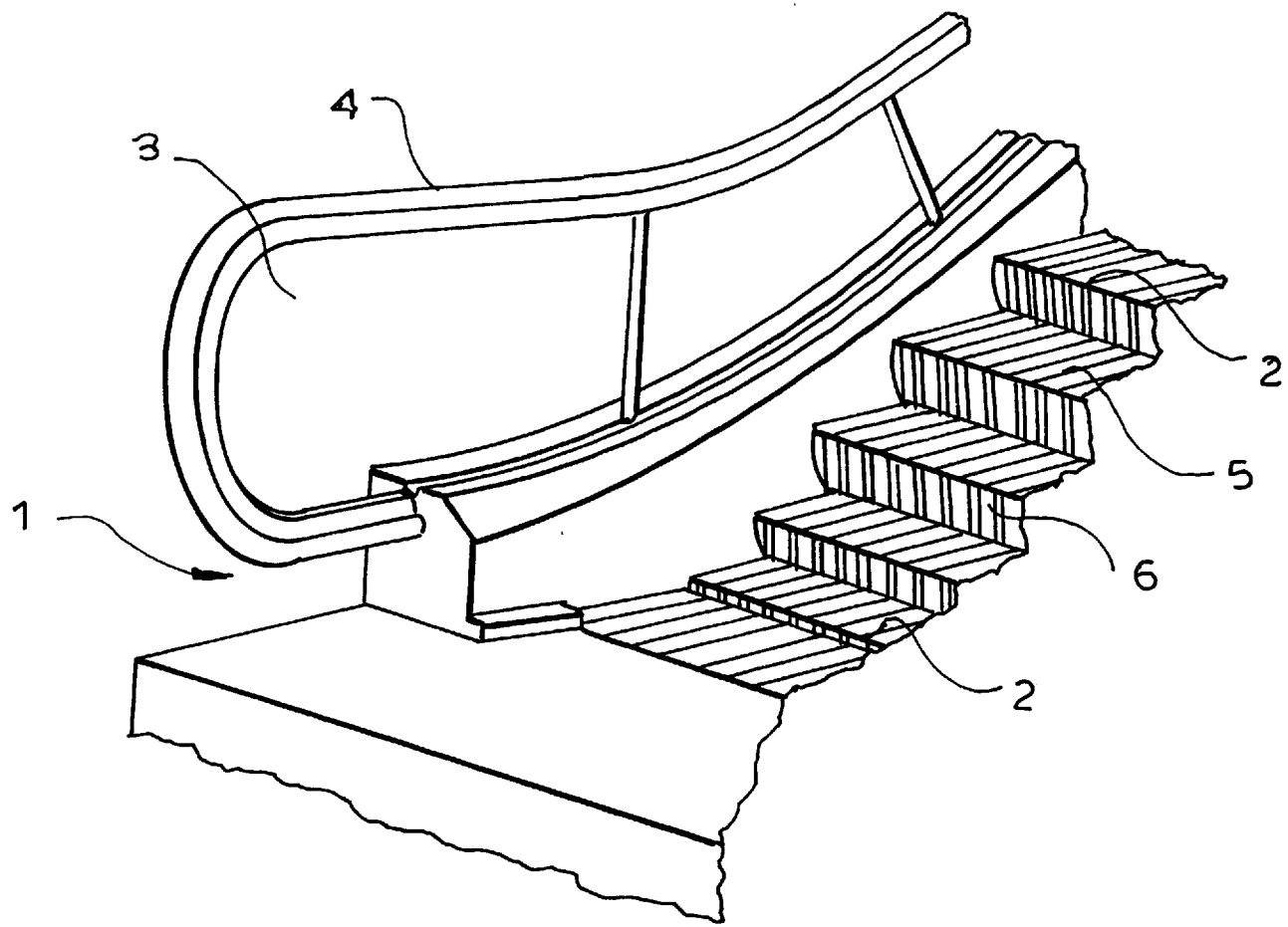
FIG. 1 is an illustration of a conventional escalator construction with which the present invention is employed.

With initial reference to FIG. 1, escalator 1 includes a plurality of step pallets 2 which are interconnected and circulate between upper and lower floors or levels. The step pallets are located between a pair of balustrades 3, only one of which is shown, which are typically provided with an endless handrail 4 which moves in synchronism with the steps. Each of the step pallets 2 includes a generally horizontally-extending step tread 5 portion and a vertical front riser portion 6 The lateral sides of both the step tread portion 5 and the riser portion 6 bear demarcation means to signify and identify their location and direct the riders away therefrom The step pallets 2 may be of a cast construction, in which the step plate 5 and front riser 6 are integrally formed.

Figure 2A:
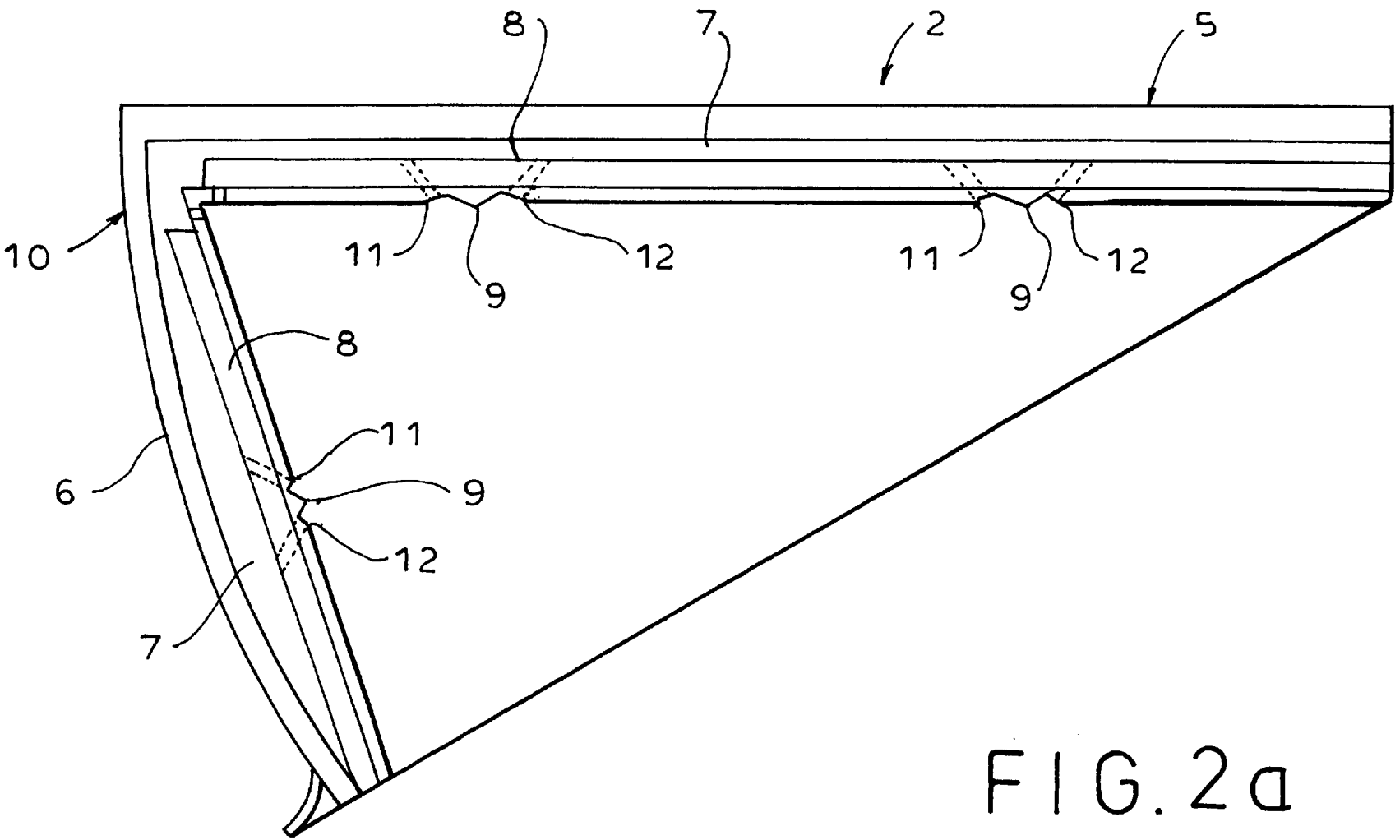
FIG. 2*a* is a side elevation view of an escalator step pallet in accordance with the invention, adapted to accept a demarcation insert thereof.
Figure 2B:
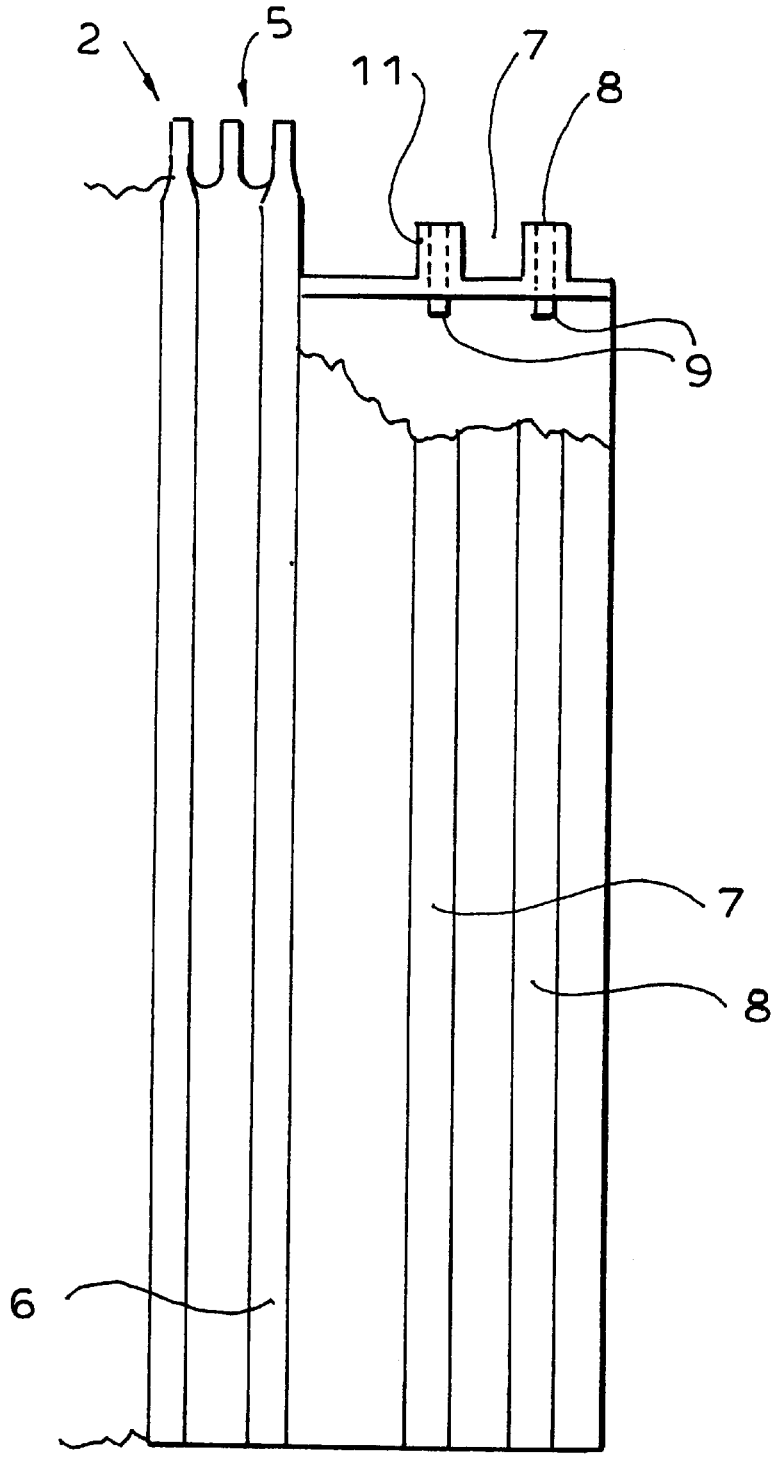
FIG. 2*b* is a front elevation view, partially broken away, of the escalator step pallet of FIG. 2*a;*
Figure 3A:
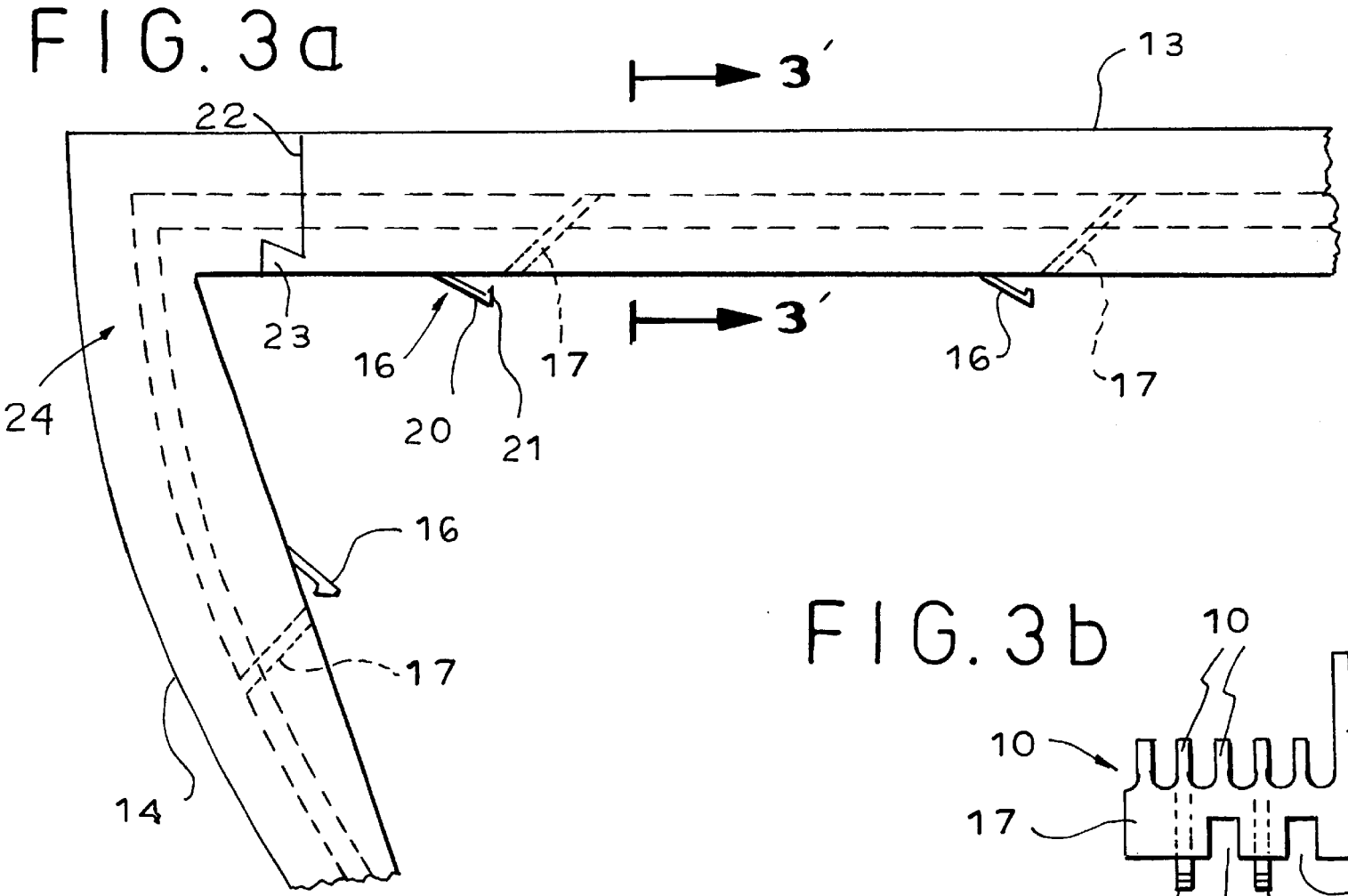
FIG. 3*a* is a side elevation view of step tread and riser demarcation inserts in accordance with the invention shown joined together.
Figure 3B:
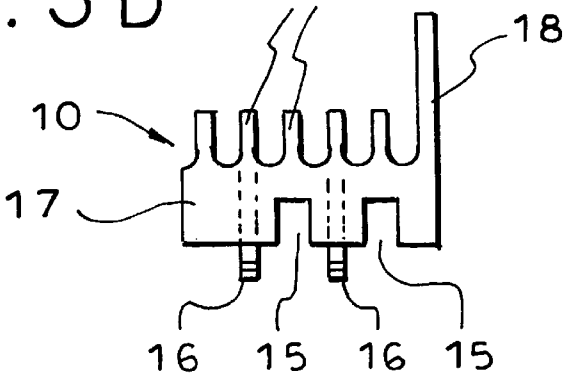
FIG. 3*b* is a front elevation view of the step tread demarcation insert in section taken along line 3'—3' of FIG. 3.

FIGS. 2*a* and 2*b* depict an escalator step pallet 2 configured for acceptance of demarcation inserts in accordance with the present invention. As depicted therein, each lateral edge of the step is formed with an exposed notch or slot 7 extending along the side of both the step tread portion 5 and the riser portion 6. Each notch is dimensioned to accept a pair of demarcation inserts, such as illustrated in FIGS. 3*a* and 3*b*. The notched portion of the step may be formed with a pair of parallel projections or guides 8 to allow positioning of the demarcation inserts thereon and assist in locking them in place. Advantageously, the step 2 may be cast with both an integral tread groove pattern 10 on both the step tread and riser portions with the slot or notch 7 and guides 8 integrally formed therein Both the step tread and riser portions are provided with one or more pairs of small projections 9 located on their interior surfaces, and pairs of angled access slots 11 and 12 through the step pallet forwardly and rearwardly of the projections. The projections 9 comprise a portion of mating locking means for the demarcation inserts while the slots 11 allow the corresponding locking means on the demarcation inserts to pass through the step pallet to engage the projections 9. The access slots 12 allow insertion of a tool to disengage the locking means to allow release of the installed demarcation inserts.

FIGS. 3*a* and 3*b* depict portions of step plate and riser demarcation inserts 13 and 14, respectively, in accordance with the invention for mounting on the escalator step of FIGS. 2*a* and 2*b*. Both demarcation inserts are formed with the tread or groove pattern to align with the pattern on the step tread portion 5 and riser portion 6. The demarcations insert may be formed with an integral raised edge 18 which is positioned to ride flush against the inner face of the escalator balustrade skirt to further direct the user away from the step edge. A pair of spaced parallel grooves 15 are located on the lower face of each insert to mate with the corresponding guides 8 on the step. Pairs of locking members 16 are provided on the lower surface of each of the demarcation inserts to assist in retaining the inserts on the step. Each locking member is in the form of a flexible arm 20 having a generally perpendicular locking tab 21 at its end. An angled access slot 17 extends through the demarcation insert adjacent the locking means and is positioned to align with the corresponding access slot 12 on the step. The demarcation inserts may be cast of a similar or complementary material to that of the step pallet, including metal and plastic compositions.

Figure 4A:
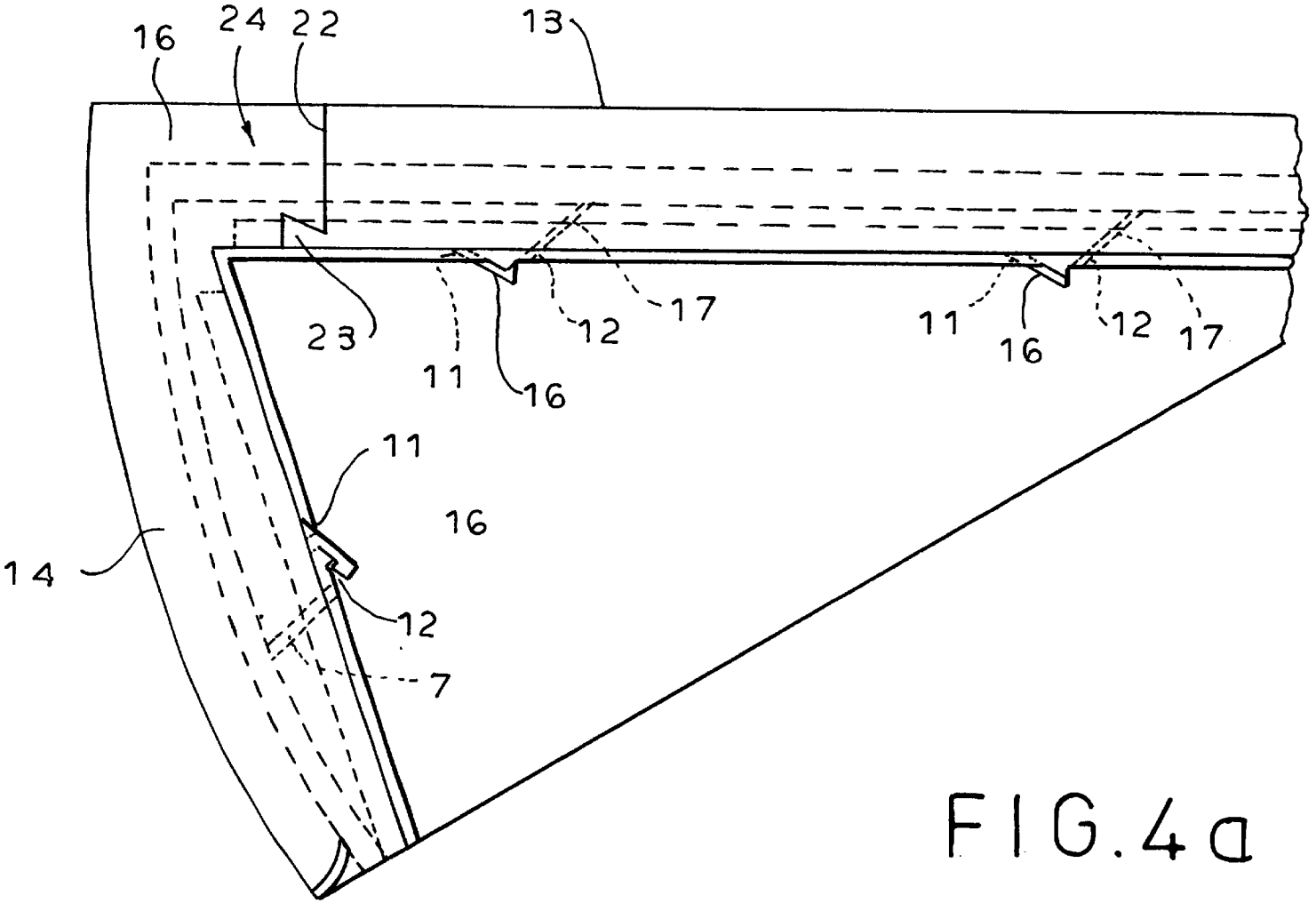
FIG. 4*a* is a side elevation view of an escalator step showing both step tread and riser demarcation inserts in place.
Figure 4B:
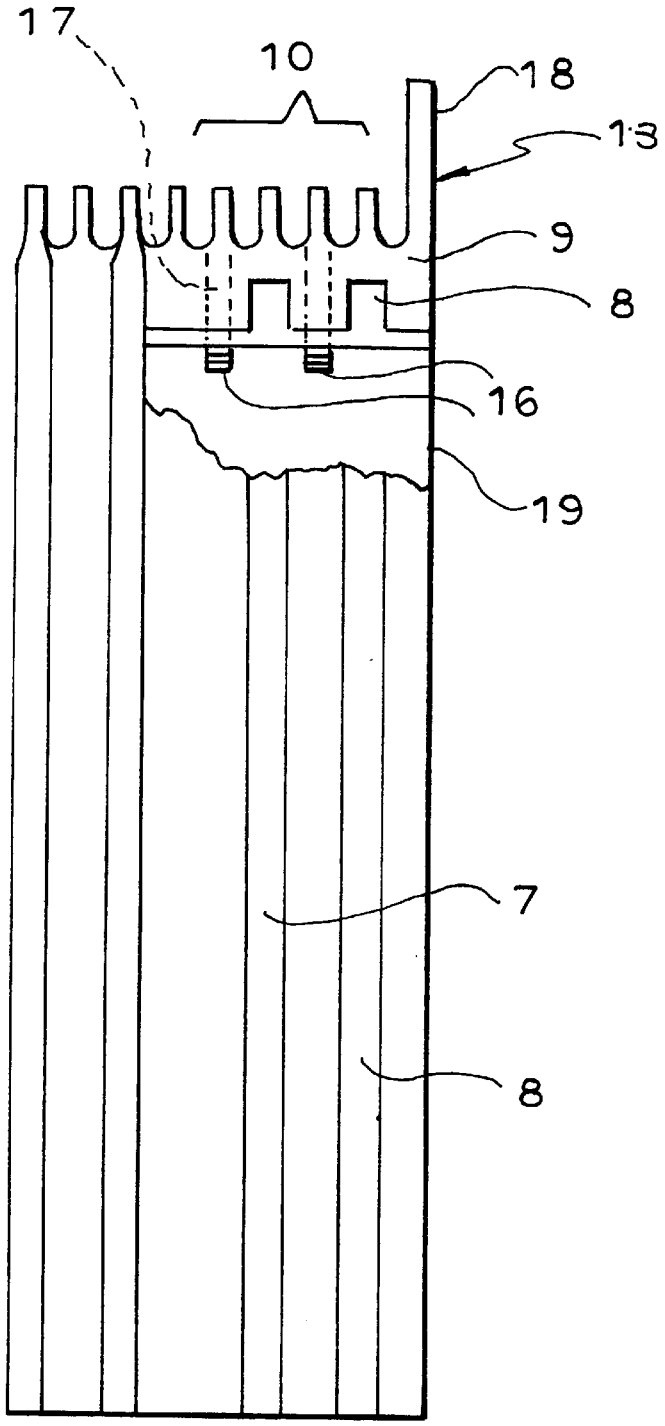
FIG. 4*b* is front elevation view, partially broken away, of the escalator step and inserts of FIG. 4*a;*

FIGS. 4*a* and 4*b* show the demarcation inserts of FIGS. 3*a* and 3*b* mounted upon the step 2 of FIGS. 2*a* and 2*b*. The tread pattern 10 on the surfaces of the inserts align with and continues the tread pattern appearing on the step tread and riser portions, while the raised edge 18 on the step tread demarcation insert serves as a flush continuation of the side edge 19 of the step. The inserts are aligned and held in place upon the step by the combination of the guides 8 and the locking members 16. The step tread demarcation insert 13 is mounted to the step tread portion 5, while the riser demarcation insert 14 mounts to and protects the edge of the riser portion 6. The inserts 13 and 14 may have an interlocking construction to removably fasten them together upon installation upon the step. As may be seen, the forward edge 22 of the step tread insert 13 is formed with a semi-dovetail flange 23. The step tread insert is preferably constructed and sized to terminate rearwardly of the step's front edge. The riser demarcation insert 14 is preferably formed in the general shape of an inverted L, the horizontal leg portion 24 thereof being sized to abut against the forward edge of the step tread demarcation insert 13. The leading edge of the leg portion 24 is formed with a semi-dovetail longitudinal recess which mates with the corresponding flange 23 on the step tread insert 13, the interlocking nature of the joint preventing the riser demarcation insert from separating from the step pallet while retaining the step tread insert on the step.

The step tread insert 13 may be mounted to the step tread portion through a generally downward and rearwardly sliding positioning action, whereby the locking means 16 pass through the access slots 11 in the step tread portion of the step into a locking engagement with the projections 9. The riser demarcation insert is then slid in a similar manner downwardly and inwardly towards the riser portion of the step, its locking means 16 engaging the corresponding projections 9 of the riser portion through the associated access slots 11 in the riser portion of the step. While the combination of the interengaged dovetail portions and the locking means and projections maintain the demarcation inserts in place upon the step pallet, the insertion of a rod-like tool from the step surface through an access slot 12/17 allows the head of the locking means 16 to be released and disengaged from the corresponding projection 9, thus freeing the demarcation insert for removal and replacement when service is required.

Figure 5:
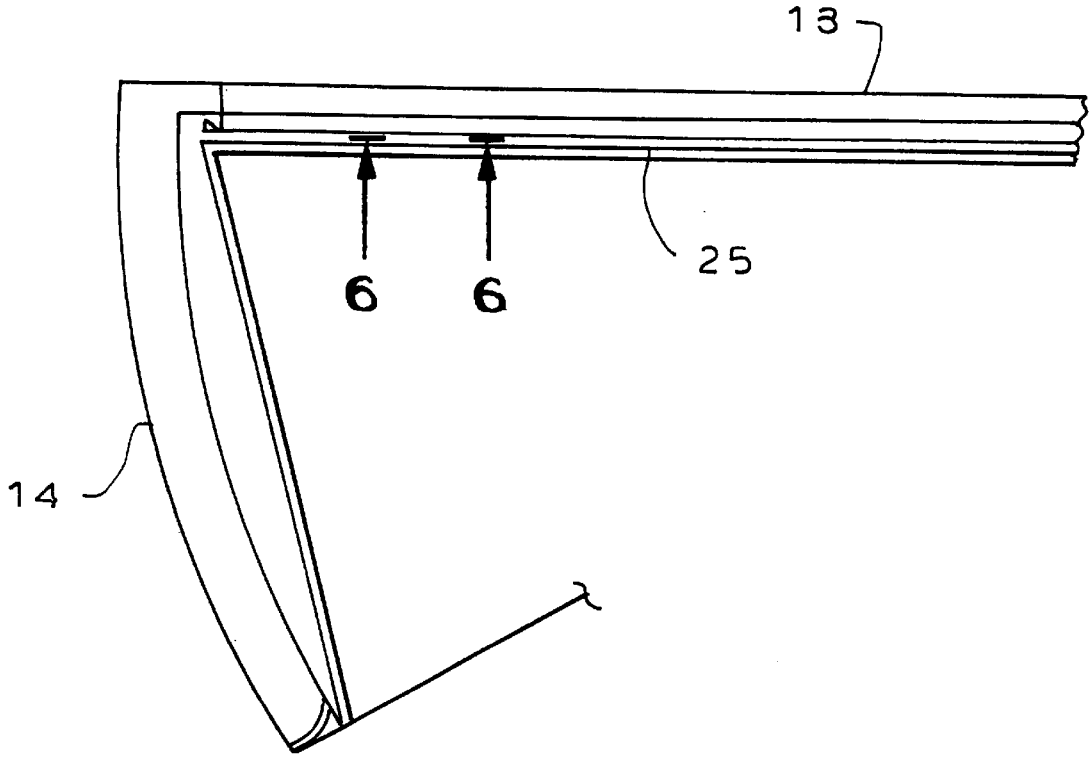
FIG. 5 is a side elevation view, in section, of an escalator step having step tread and riser inserts mounted thereon by an alternative locking means.
Figure 6:
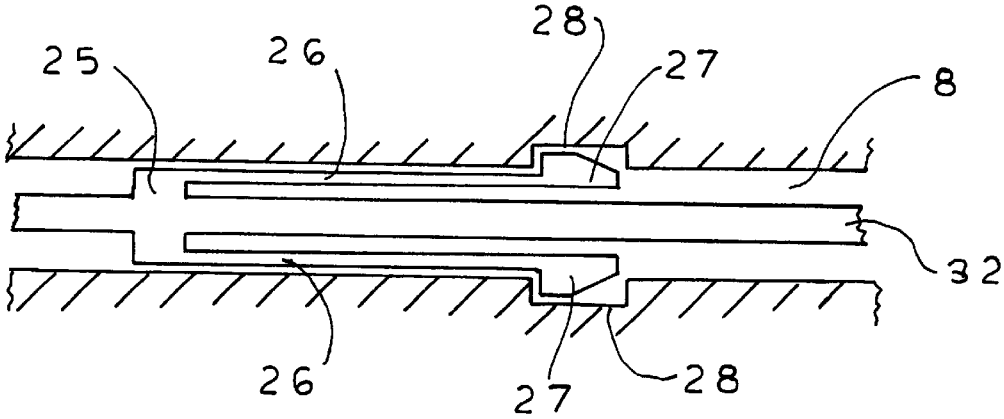
FIG. 6 is a detail view of the locking means of FIG. 5 in section taken along line 6—6 of FIG. 5.

FIGS. 5 and 6 depict an alternative means for mounting the demarcation inserts to the step pallet. As shown therein, pairs of locking elements 25 may be located along the bottom edge of the inserts for retention purposes. As further depicted in FIG. 6, the bottom edge of the demarcation insert 32 may be formed with a pair of opposed lock arms 26 having enlarged head portions 27. The corresponding guides 8 in the step are formed with slots or detents 28 to receive the heads, the flexibility of the arms allowing the lock arms to flex inwardly to allow the heads to pass into the retention slots. Alternatively, a keyway may be formed into the guides to allow the heads to slide into engagement with the retaining grooves. An angled access slot (not seen) may be provided to allow a tool to be inserted to release the heads 27 when removal of the demarcation insert is required.

Figure 9:
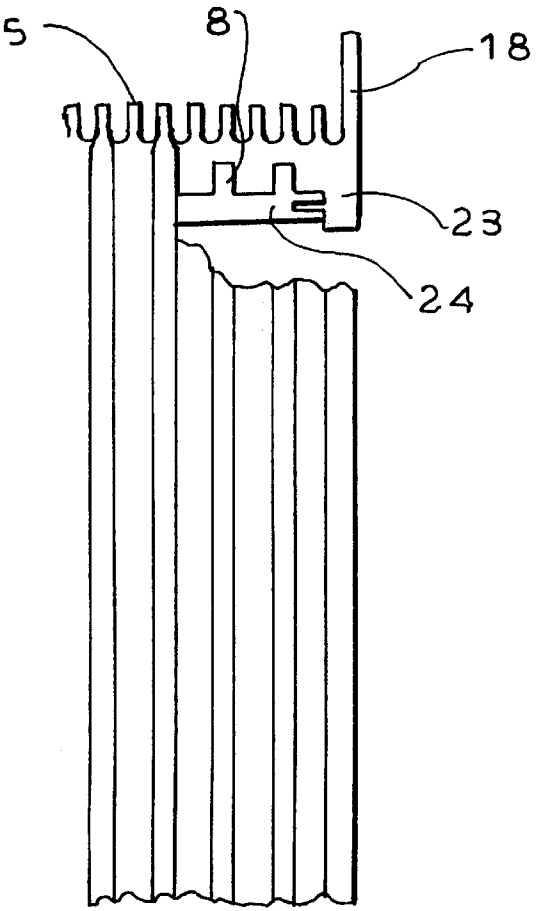
FIG. 9 is a front elevation view, partially broken away, depicting the demarcation inserts of FIG. 8 mounted on the step pallet of FIG. 8.

FIG. 7 depicts a step pallet 2 in which both the step tread and riser portions include a laterally-extending channel 29 formed into the side edges thereof, in addition to the guides 8. FIG. 8 depicts an associated step tread demarcation insert 13 in section, in which a corresponding lateral flange 30 is provided. FIG. 9 presents the demarcation insert mated to the tread plate portion. Once again, the step plate demarcation insert is mounted on the step, with a sliding fit rearwardly from the front of the step. The riser demarcation insert is then mounted to the riser portion of the step with a similar sliding fit downwardly onto the front of the step, the dovetail elements on the two inserts joining the elements together and retaining the tread plate insert in proper front-to-back orientation. In this construction, the riser demarcation insert can have a relatively small horizontally-extending portion, without a lateral flange. The channel 29 for the step tread portion can start behind the location of the horizontal portion of the riser insert to avoid interference when the riser insert is installed.

Figure 10:
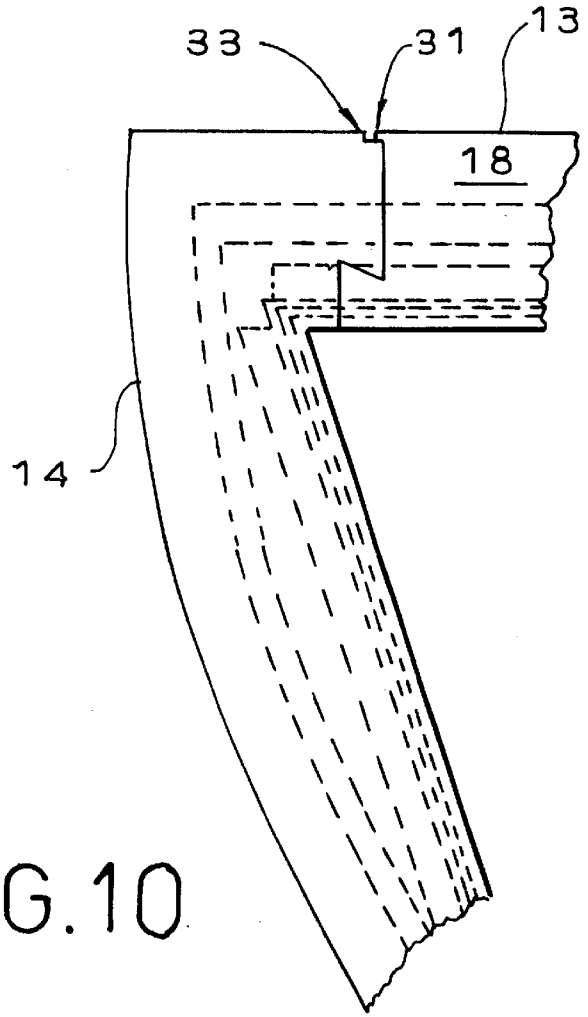
FIG. 10 is a side elevation view of a pair of interconnected demarcation inserts of FIG. 8 showing the interconnection therebetween.

As seen in FIG. 10, the rearward edge of the riser demarcation insert can be provided with a cut-away or recessed portion 33 on one the side rail portion. The side rail portion of the step tread insert is formed with a corresponding small flap or tab portion 31. Additionally or alternatively the recessed and flap portions may be located at different locations, such as on the tread-forming areas of the inserts. The flap is dimensioned to be resilient, allowing it to be slightly disposed upwardly by use of a suitable tool when the riser insert is installed to allow passage of the riser insert into engagement with the dovetail portion of the step tread insert. With the riser insert in place the flap mates with the recessed portion 33, retaining the riser insert in place. For insert removal a tool can again be used to slightly displace the flap to allow the riser insert to be raised and removed, followed by removal of the step tread insert. Advantageously, this construction eliminates the need for hooked arms as previously described.

We claim:

1. An escalator step, comprising a step tread portion joined to a front riser portion, a pair of side edges extending along the joined step tread and front riser portions, the side edges each having a peripheral slot extending therealong, the slot having a bottom wall and a pair of parallel guides extending upwardly from the bottom wall along the length of the slot; a demarcation insert removably mounted in each of the slots, each of the demarcation inserts having a lower surface having parallel channels therein to accept the parallel guides; and locking means located on said demarcation inserts and step tread and riser portions to removably maintain the demarcation inserts within the slots.

2. The escalator step of claim 1 wherein the demarcation insert mounted in a slot comprises first and second interlocking inserts.

3. The escalator step of claim 2 wherein the first interlocking insert is mounted to the step tread portion and the second interlocking insert is mounted to the front riser portion.

4. The escalator step of claim 3 wherein the first and second interlocking inserts include mating dovetail connector portions.

5. The escalator step of claim 3, wherein at least one of the first and second interlocking inserts include a raised edge.

6. The escalator step of claim 1 wherein the locking means comprise a lock arm on the demarcation insert and a mating projection on at least one of the step tread and riser portions.

7. The escalator step of claim 1 wherein the locking means comprise a lock arm on the demarcation insert and a mating recess on at least one of the step tread and riser portions.

8. The escalator step of claim 4 wherein the locking means comprise a longitudinal flange on the demarcation inserts and a mating channel on at least one of the step tread and riser portions.

9. The escalator step of claim 6 further including an access channel through one of the step tread and riser portions to accept the lock arm.

10. The escalator step of claim 9 further including a second access channel having a first portion through one of the step tread and riser portions and a second portion through the demarcation insert for tool access to the lock arm head when the lock arm engages the mating projection.

11. The escalator step of claim 8 further including complementary tab and recess connection means located on adjacent portions of the first and second interlocking inserts.

* * * * *